US009625865B2

(12) United States Patent
Matsue et al.

(10) Patent No.: US 9,625,865 B2
(45) Date of Patent: Apr. 18, 2017

(54) IMAGE FORMING APPARATUS AND CONTROL METHOD FOR IMAGE FORMING APPARATUS

(71) Applicants: Natsumi Matsue, Kanagawa (JP); Kohta Fujimori, Kanagawa (JP); Kayoko Tanaka, Tokyo (JP)

(72) Inventors: Natsumi Matsue, Kanagawa (JP); Kohta Fujimori, Kanagawa (JP); Kayoko Tanaka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/052,272

(22) Filed: Feb. 24, 2016

(65) Prior Publication Data

US 2016/0266532 A1 Sep. 15, 2016

(30) Foreign Application Priority Data

Mar. 10, 2015 (JP) ..... 2015-047216

(51) Int. Cl.
*G03G 15/00* (2006.01)

(52) U.S. Cl.
CPC ..... *G03G 15/553* (2013.01); *G03G 15/5054* (2013.01)

(58) Field of Classification Search
CPC ..... G03G 15/553; G03G 15/556; G03G 15/5058; G03G 2215/00042; G03G 15/5041; G03G 15/5054
See application file for complete search history.

(56) References Cited

U.S. PATENT DOCUMENTS

| | | | | |
|---|---|---|---|---|
| 4,799,082 | A | 1/1989 | Suzuki | |
| 6,148,158 | A * | 11/2000 | Amemiya | G03G 15/01 358/519 |
| 2010/0150589 | A1 * | 6/2010 | Carter, Jr. | G03G 15/0194 399/49 |
| 2014/0079420 | A1 | 3/2014 | Sato | |

FOREIGN PATENT DOCUMENTS

| | | |
|---|---|---|
| JP | 5-322758 | 12/1993 |
| JP | 10-333416 | 12/1998 |
| JP | 2012-022208 | 2/2012 |
| JP | 2014-021248 | 2/2014 |
| JP | 2014-228638 | 12/2014 |

OTHER PUBLICATIONS

Extended European Search Report issued Jul. 8, 2016 in Patent Application No. 16158895.9.

* cited by examiner

*Primary Examiner* — Sandra Brase
(74) *Attorney, Agent, or Firm* — Oblon, McClelland, Maier & Neustadt, L.L.P.

(57) ABSTRACT

An image forming apparatus includes an image bearer that bears a toner image, a sensor, an adhesion amount calculator, and a wavelength determiner. The sensor includes a light source that emit light onto the image bearer, and an image element that detects reflected light that is emitted from the light source and reflected from the image bearer. The adhesion amount calculator calculates a toner adhesion amount of the toner image on the image bearer based on the reflected light having at least one wavelength among a plurality of wavelengths detected by the sensor. The wavelength determiner determines, based on color information of the image bearer detected by the sensor, a wavelength to be used in calculation of the toner adhesion amount by the adhesion amount calculator.

10 Claims, 8 Drawing Sheets

IMAGE FORMING APPARATUS AND CONTROL METHOD FOR IMAGE FORMING APPARATUS

CROSS-REFERENCE TO RELATED APPLICATION

This patent application is based on and claims priority pursuant to 35 U.S.C. §119 to Japanese Patent Application No. 2015-047216, filed on Mar. 10, 2015, in the Japan Patent Office, the entire disclosure of which is hereby incorporated by reference herein.

BACKGROUND

Technical Field

Exemplary aspects of the present invention relate to an image forming apparatus and a control method for the image forming apparatus.

Related Art

There are various electrophotographic image forming apparatuses that are known as image forming apparatuses such as copiers, facsimile machines, printers, or multifunction peripherals having two or more copying, printing, and facsimile functions. Such an image forming apparatus performs image forming processes, including formation of an electrostatic latent image on a surface of a photoconductor drum, development of the electrostatic latent image on the photoconductor drum with toner serving as developer, transfer of the developed image to a recording medium (also referred to as paper, transfer paper, recording paper, a sheet, and a recording material) by a transfer device such as an intermediate transfer belt, and fixing of the toner image on the transfer paper by a fixing device using heat and pressure.

Such an image forming apparatus forms a test pattern for image density adjustment on the intermediate transfer belt serving as an image bearer, and detects a toner amount of the test pattern to control image forming conditions. A reflective optical sensor is usually used for the toner amount detection.

In particular, high-speed apparatuses used in the production printing field include a line sensor (or density sensor) capable of detecting image density in a main scanning direction to detect the image density on paper. The image density is detected to maintain consistent image density within a page.

For example, a contact image sensor (CIS) used in a reading unit of a scanner is employed as such a line sensor. The CIS includes an image sensor such as a white light source and a complementary metal oxide semiconductor (CMOS). The CIS can obtain reflectances with respect to the three colors red (R), green (G), and blue (B) as outputs.

In addition, there is a method by which the CIS is arranged on the intermediate transfer belt to calculate a toner adhesion amount (hereinafter, also referred to as an adhesion amount) on the intermediate transfer belt based on the outputs of R, G, and B.

SUMMARY

In at least one embodiment of this disclosure, there is provided an improved image forming apparatus that includes an image bearer that bears a toner image, a sensor, an adhesion amount calculator, and a wavelength determiner. The sensor includes a light source that emits light onto the image bearer, and an image element sensitive to a plurality of wavelength regions each having a different visible light range. The image element detects reflected light that is emitted from the light source and reflected from the image bearer. The adhesion amount calculator calculates a toner adhesion amount of the toner image on the image bearer based on the reflected light having at least one wavelength among a plurality of wavelengths detectable by the sensor. Based on color information of the image bearer detected by the sensor, the wavelength determiner determines a wavelength to be used in calculation of the toner adhesion amount by the adhesion amount calculator.

In at least one embodiment of this disclosure, there is provided an improved method for controlling an image forming apparatus including an image bearer and a sensor. The method includes forming a toner image on the image bearer of the image forming apparatus, detecting reflected light having a plurality of wavelengths reflected from the image bearer by the sensor of the image forming apparatus, calculating a toner adhesion amount of the toner image on the image bearer, and determining a wavelength to be used in calculation of the toner adhesion amount. The toner adhesion amount of the toner image on the image bearer is calculated based on the reflected light having at least one wavelength among the plurality of wavelengths detected by the sensor. The wavelength to be used in calculation of the toner adhesion amount by the adhesion amount calculation is determined based on the color information of the image bearer detected by the sensor.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
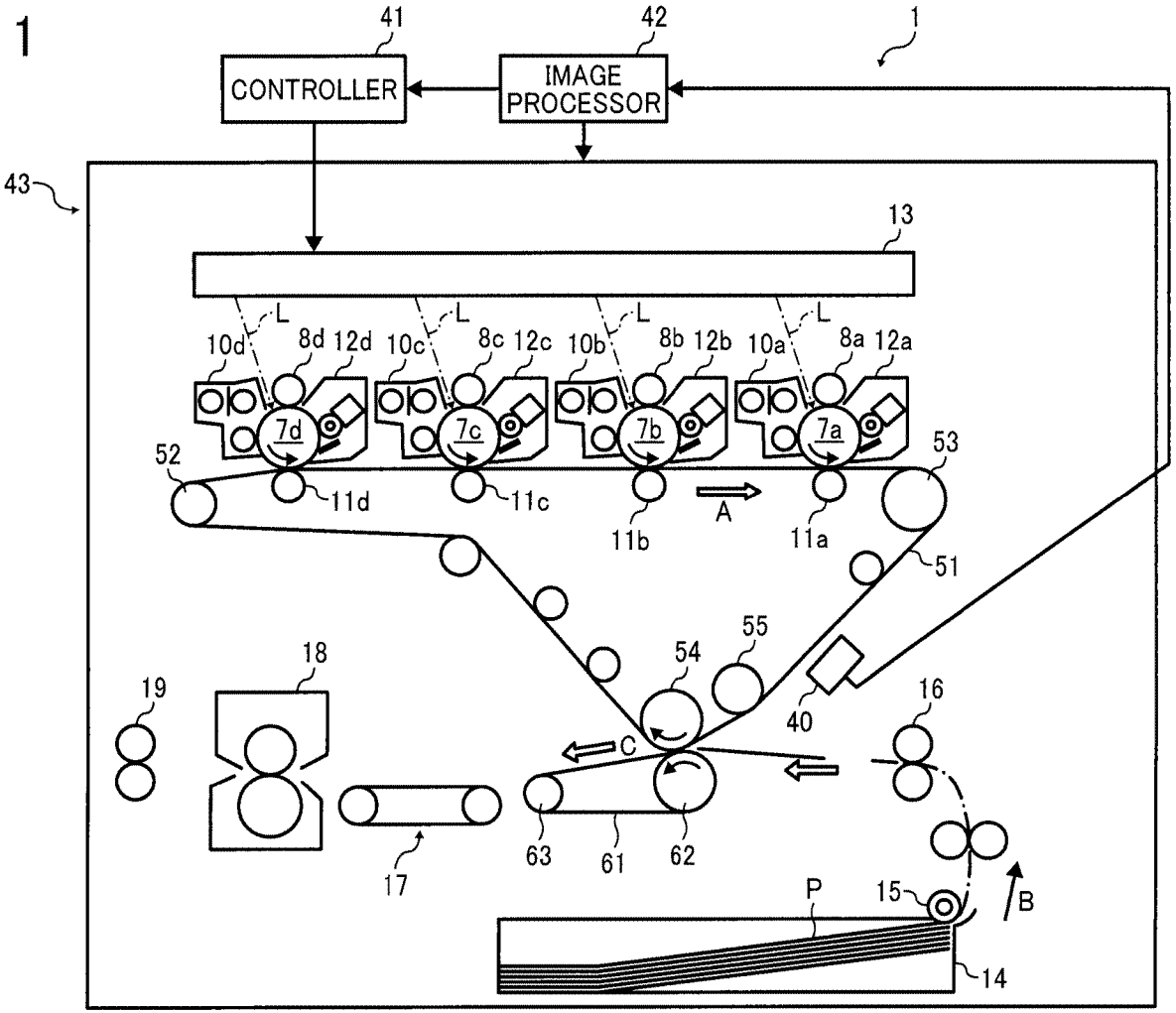
FIG. 1 is a schematic diagram illustrating an image forming apparatus according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

In most cases, arrangement of a light source and a density sensor causes diffuse reflection. Thus, when the density sensor detects a black toner on a black intermediate transfer belt, a difference in reflectance is small and therefore sensitivity is low. This degrades the detection accuracy of black toner adhesion amount. Meanwhile, there is a method for enhancing the detection accuracy of black toner adhesion amount by increasing a light amount of a light source compared to a case where color toners are detected, or outputs of all of R, G, and B are added to detect black toner on a black intermediate transfer belt.

Thus, for enhancement of such detection accuracy, it is important that a toner adhesion amount is detected using light with a wavelength that has a larger reflectance difference between the toner and the intermediate transfer belt. However, since color of the intermediate transfer belt varies depending on the production lot (also called initial variation) and individual differences, a wavelength having a large reflectance difference with respect to toner differs for each belt. Consequently, in a case where a uniform reading wavelength is determined, reading cannot be performed with a suitable wavelength. This degrades the detection accuracy of the toner adhesion amount.

Moreover, toner filming on the intermediate transfer belt may change the color of the intermediate transfer belt over time. In such a case, if light having the same wavelength as that at the beginning of use of the intermediate transfer belt is applied, a reflectance difference with respect to the toner becomes smaller. Consequently, a toner adhesion amount cannot be calculated with accuracy.

Figure 9A:
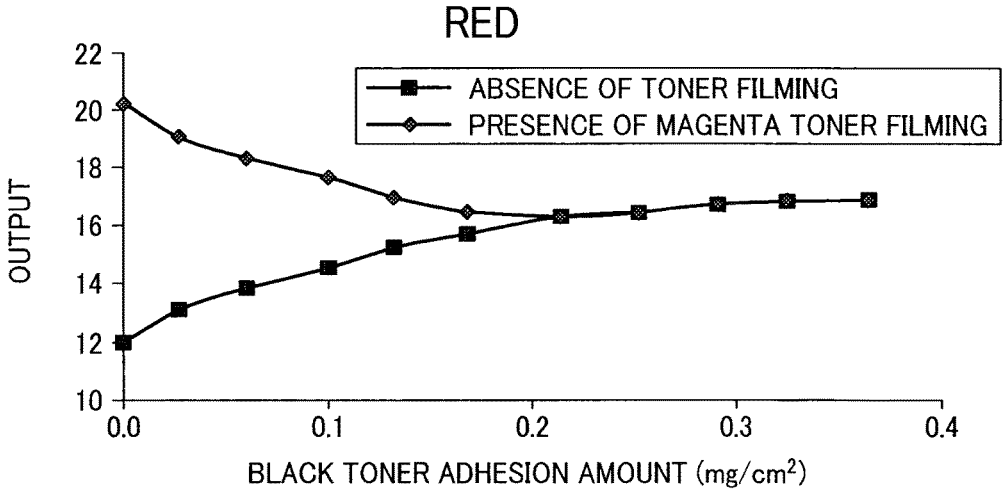
FIGS. 9A, 9B, and 9C are graphs respectively illustrating relations between black toner adhesion amounts on the intermediate transfer belt and R, G, and B outputs when magenta toner filming is present.
Figure 9B:
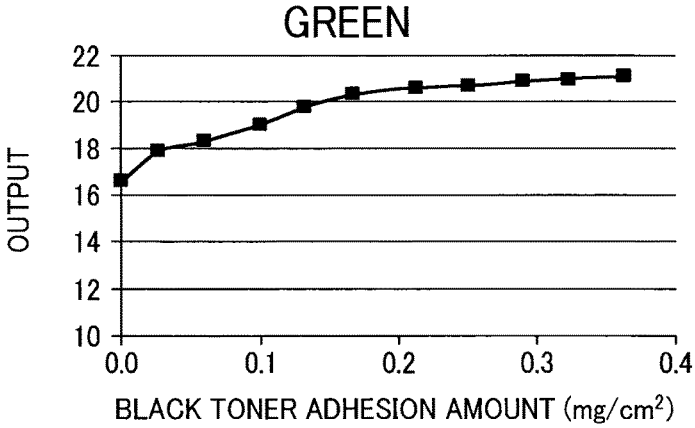
Figure 9C:
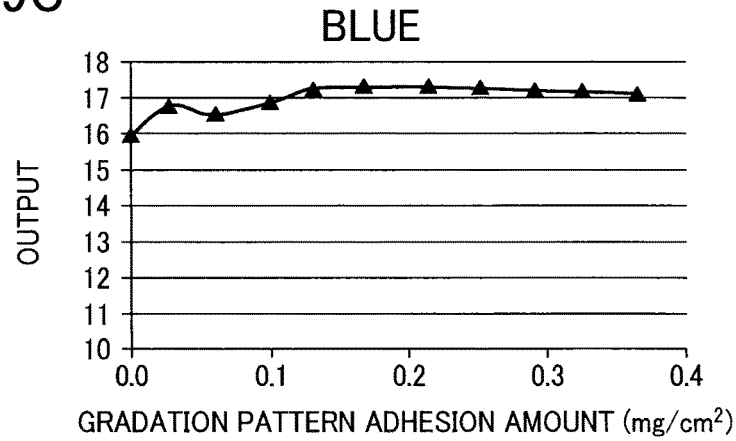

For example, FIGS. 9A, 9B, and 9C illustrate relations between black toner adhesion amounts on an intermediate transfer belt and R, G, and B outputs. As illustrated in FIG. 9A, on the intermediate transfer belt at the beginning of use, an R output increases as a black toner adhesion amount ($mg/cm^2$) increases. However, in a case where a film of a magenta toner is generated on the intermediate transfer belt, the R output in a background area of the intermediate transfer belt increases, whereas the R output with respect to an increase in the black toner adhesion amount decreases. Consequently, an increase/decrease in the R output with respect to the toner adhesion amount can be reversed depending on color of filming. Moreover, a failure can occur if a toner adhesion amount with respect to the R output is calculated by the same method as that at beginning of use of the intermediate transfer belt.

According to the exemplary embodiments of the present invention described below, a toner adhesion amount on an image bearer can be calculated with high accuracy.

Hereinafter, exemplary embodiments of the present invention are described with reference to FIGS. 1 through 9.

[First Exemplary Embodiment]

An image forming apparatus according to an exemplary embodiment of the present invention calculates a toner adhesion amount of a toner image (an adjustment pattern T) formed on an image bearer (an intermediate transfer belt 51), and adjusts an image forming condition based on a calculation result. The image forming apparatus includes a sensor (a density sensor 40), an adhesion amount calculator (an adhesion amount calculator 73), and a wavelength determiner (a wavelength determiner 72). The sensor includes a light source (a light source 100) that emits light, and an image element (an image element 102) sensitive to a plurality of wavelength regions each having a different visible light range. The image element detects reflected light that is emitted from the light source and reflected from the image bearer. The adhesion amount calculator calculates the toner adhesion amount of the toner image formed on the image bearer based on the reflected light having at least one wavelength among a plurality of wavelengths detected by the sensor. The wavelength determiner determines, based on color information of the image bearer detected by the sensor, a wavelength to be used for calculation of the toner adhesion amount by the adhesion amount calculator.

(Image Forming Apparatus)

FIG. 1 is a schematic diagram illustrating the image forming apparatus 1 according to the exemplary embodiment of the present invention. The image forming apparatus 1 includes a density sensor 40, a controller 41, an image processor 42, and an image forming unit 43.

The controller 41, for example, includes a central processing unit (CPU) and a memory to control the image forming unit 43. In particular, the controller 41 allows the image forming unit 43 to form an image according to a control parameter. The control parameter is used as a condition when the image forming unit 43 forms an image. The image processor 42, for example, includes an application specific integrated circuit (ASIC) and a memory to perform various image processes on image data input from a scanner or a client device such as a personal computer (PC).

The image forming unit 43 includes photoconductors 7 (7*a*, 7*b*, 7*c*, and 7*d*), charging devices 8 (8*a*, 8*b*, 8*c*, and 8*d*), developing devices 10 (10*a*, 10*b*, 10*c*, and 10*d*), cleaner 12 (12*a*, 12*b*, 12*c*, and 12*d*), an exposure device 13, an intermediate transfer belt 51, a secondary transfer belt 61, and a fixing device 18.

On the photoconductors 7*a*, 7*b*, 7*c*, and 7*d*, toner images of different colors are formed. Particularly, toner images of black (Bk), magenta (M), cyan (C), and yellow (Y) are respectively formed on the photoconductors 7*a*, 7*b*, 7*c*, and 7*d*. In the present exemplary embodiment, each of the photoconductors 7*a*, 7*b*, 7*c*, and 7*d* has a drum shape.

Alternatively, an endless-belt-type photoconductor can be used. In such a case, the endless-belt-type photoconductor is looped around a plurality of rollers and rotated.

The intermediate transfer belt 51 of an endless belt member is disposed opposite the four photoconductors 7*a*, 7*b*, 7*c*, and 7*d*. The intermediate transfer belt 51 serves as an intermediate transfer member of an image bearer. An outer circumferential surface of each of the photoconductors 7*a*, 7*b*, 7*c*, and 7*d* contacts an outer circumferential surface of the intermediate transfer belt 51. In the present exemplary embodiment, the intermediate transfer belt 51 is looped around support rollers (support rotators) such as a tension roller 52, a drive roller 53, a repulsion roller 54, and an inlet roller 55. The drive roller 53 out of these support rollers is rotated by a drive source. The rotation of the drive roller 53 moves the intermediate transfer belt 51 toward a direction indicated by an arrow A shown in FIG. 1.

The intermediate transfer belt 51 can have a multi-layer structure or a single layer structure. If the intermediate transfer belt 51 includes a multi-layer belt, for example, a base layer is preferably made of a low-expansion material such as fluorine resin, a polyvinylidene difluoride (PVDF) sheet, and polyimide resin, and a belt outer circumferential surface preferably includes a smooth coat layer made of a material such as fluorine resin. On the other hand, if the intermediate transfer belt 51 includes a single layer belt, a material such as PVDF, polycarbonate (PC), and polyimide can be used.

Configurations and operations for forming toner images on the photoconductors 7*a*, 7*b*, 7*c*, and 7*d* are substantially similar to every other, except for the color of toner. Configurations and operations for primarily transferring the toner images to the intermediate transfer belt 51 are substantially similar, differing only in the color of toner used. Thus, a description is hereinafter given of configurations and operations for forming a black toner image on the photoconductor 7*a* for black, and primarily transferring the black toner image to the intermediate transfer belt 51. Descriptions of other colors are omitted.

The photoconductor 7*a* for black is rotated counterclockwise in FIG. 1. A discharging device irradiates an outer circumferential surface of the photoconductor 7*a* with light to initialize a surface potential of the photoconductor 7*a*. The charging device 8*a* uniformly charges the initialized outer circumferential surface of the photoconductor 7*a* with a predetermined polarity (a negative polarity in the present exemplary embodiment). Then, the exposure device 13 emits a modulated laser beam L to the charged outer circumferential surface of the photoconductor 7*a*, thereby forming an electrostatic latent image on the outer circumferential surface of the photoconductor 7*a*.

In the present exemplary embodiment, the exposure device 13 emitting the laser beam L includes a laser writing device. However, for example, the exposure device 13 can include a light emitting diode (LED) array and an imaging unit. When the electrostatic latent image formed on the photoconductor 7*a* passes through a developing area opposite the developing device 10*a*, the electrostatic latent image is developed as a black toner image.

On an inner circumferential surface of the intermediate transfer belt 51, a primary transfer roller 11*a* is positioned opposite the photoconductor 7*a*. The primary transfer roller 11*a* contacts the inner circumferential surface of the intermediate transfer belt 51, so that an appropriate primary transfer nip is retained between the photoconductor 7*a* and the intermediate transfer belt 51. The primary transfer roller 11*a* receives a primary transfer voltage having a polarity opposite to a toner charge polarity of the toner image formed on the photoconductor 7*a* (a positive polarity in the present exemplary embodiment). This forms a primary transfer electric field between the photoconductor 7*a* and the intermediate transfer belt 51, and the toner image on the photoconductor 7*a* is electrostatically and primarily transferred to the intermediate transfer belt 51 rotated in synch with the photoconductor 7*a*. After the toner image is primarily transferred to the intermediate transfer belt 51, the cleaner 12*a* removes a residual transfer toner from the outer circumferential surface of the photoconductor 7*a*.

In a full color mode using toner images of all four colors, a magenta toner image, a cyan toner image, and a yellow toner image are each formed by the respective photoconductors 7*b*, 7*c*, and 7*d* in addition to the black toner image formed by the photoconductor 7*a*. The formation of each of the magenta, cyan, and yellow toner images is similar to that of the black toner image except for the color of toner. The magenta, cyan, and yellow toner images are primarily transferred in sequence to overlap the black toner image which has previously been primarily transferred to the intermediate transfer belt 51.

In a monotone (black) color mode, a contact and separation unit separates the primary transfer rollers 11*b*, 11*c*, and 11*d* from the respective photoconductors 7*b*, 7*c*, and 7*d*, so that the photoconductors 7*b*, 7*c*, and 7*d* for magenta, cyan, and yellow are separated from the intermediate transfer belt 51. Accordingly, only a black toner image is primarily transferred to the intermediate transfer belt 51 in a state in which only the photoconductor 7*a* for black is in contact with the intermediate transfer belt 51.

Moreover, a sheet feeding device 14 is disposed in a lower portion of the image forming apparatus 1. The sheet feeding device 14 feeds a transfer sheet P as a recording medium in a direction indicated by an arrow B shown in FIG. 1 by rotation of a sheet feeding roller 15. The transfer sheet P fed by the sheet feeding device 14 is conveyed to a secondary transfer nip at a predetermined time by a registration roller pair 16. In the secondary transfer nip, a portion of the intermediate transfer belt 51 looped around the repulsion roller 54 contacts a portion of the secondary transfer belt 61 disposed opposite the intermediate transfer belt 51. Herein, a secondary transfer voltage power source as a transfer voltage output unit applies a predetermined secondary transfer voltage to the repulsion roller 54, thereby secondarily transferring the toner image on the intermediate transfer belt 51 to the transfer sheet P.

The secondary transfer belt 61 is looped around a secondary transfer roller 62 and a separation roller 63. One of the secondary transfer roller 62 and the separation roller 63 (support rotators) is rotated as a driver roller, so that the secondary transfer belt 61 moves in a direction indicated by an arrow C in FIG. 1. The transfer sheet P with the secondarily transferred toner image is conveyed with the movement of the secondary transfer belt 61 in a state in which the transfer sheet P is electrostatically absorbed to the outer circumferential surface of the secondary transfer belt 61. Then, the transfer sheet P is separated from the outer circumferential surface of the secondary transfer belt 61 using curvature of a portion of the secondary transfer belt 61 wound around the separation roller 63. The transfer sheet P is further conveyed to a downstream side in a sheet conveyance direction by a conveyance belt 17 disposed on a downstream side of the secondary transfer belt 61 in the sheet conveyance direction. When the transfer sheet P passes through the fixing device 18, the toner image on the transfer sheet P is fixed onto the transfer sheet P with heat and pressure. After passing through the fixing device 18, the transfer sheet P is discharged outside via a discharge roller pair 19 disposed in a discharge unit.

(Density Sensor)

Figure 2:
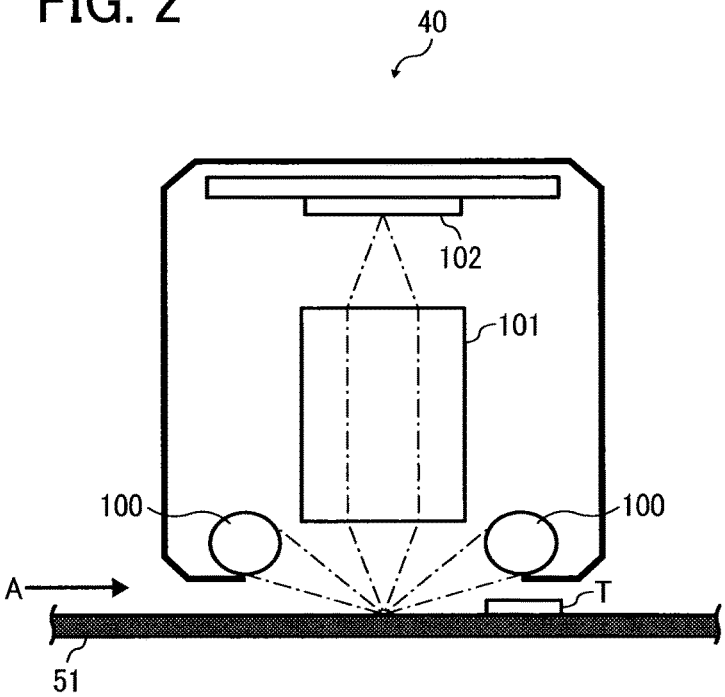
FIG. 2 is a schematic diagram illustrating a density sensor of the image forming apparatus.

FIG. 2 is a schematic diagram illustrating the density sensor 40 of the image forming apparatus 1. The density sensor 40 optically reads an adjustment pattern T, serving as a toner image for adjustment, formed on the intermediate transfer belt 51. In the present exemplary embodiment, the density sensor 40 serves as a line sensor, and has a reading width that is longer than an image forming area in a belt width direction on the intermediate transfer belt 51 (a direction (a main scanning direction) perpendicular to a direction of movement of the intermediate transfer belt 51 indicated by the arrow A shown in FIGS. 1 and 2). Thus, the density sensor 40 can detect a toner adhesion amount of the adjustment pattern T across the entire area on the intermediate transfer belt 51.

The density sensor 40 is disposed on a downstream side in the direction of movement (indicated by the arrow A shown in FIG. 1) of the intermediate transfer belt 51 with respect to the primary transfer roller 11*a* disposed on an extreme downstream side among the four primary transfer rollers 11*a*, 11*b*, 11*c*, and 11*d* in the direction of movement (indicated by the arrow A shown in FIG. 1) of the intermediate transfer belt 51. Moreover, the density sensor 40 is disposed on an upstream side in the direction of movement (indicated by the arrow A shown in FIG. 1) of the intermediate transfer belt 51 with respect to the secondary transfer roller 62.

As illustrated in FIG. 2, the density sensor 40 includes a light source 100, a lens array 101, and an image element 102.

The light source 100 emits white light. As for the light source 100, for example, an LED array or a unit with a light emitting element on an end portion of a light guide can be used. Moreover, a SELFOC (registered trademark) lens is used as the lens array 101.

As for the image element 102, a sensor such as a CMOS sensor or a charge-coupled device (CCD) sensor can be used. The image element 102 includes a plurality of image elements arranged side by side in a line. The image element 102 receives light focused by the lens array 101, and outputs a signal according to the strength of the received light. The image element 102 includes red, green and blue filters on a surface thereof to separately receive reflected light for each of R, G, and B.

Moreover, a movable calibration plate (not illustrated) is disposed between the density sensor 40 and the intermediate transfer belt 51. For example, Lumirror E20 (manufactured by Toray Industries, Inc.) can be used as the calibration plate that is used for shading correction before an output from the intermediate transfer belt 51 or a toner adhesion amount on the intermediate transfer belt 51 is read.

The present exemplary embodiment is described using an example in which the light source 100 emits a white light, and the image element 102 having sensitivity to each of R, G, and B lights is used. However, the present exemplary embodiment is not limited thereto as long as color can be detected. For example, the light source 100 may turn on R, G, and B in order. Alternatively, a sensor that uses three light sources of R, G, and B may be used as the image element 102. In such a case, the image element 102 has sensitivity across the entire wavelength area.

(Controller)

Figure 3:
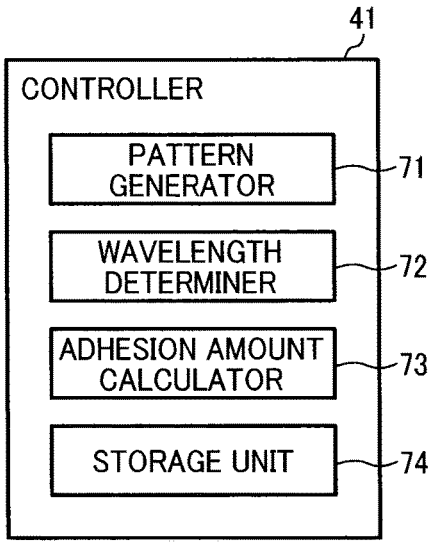
FIG. 3 is a functional block diagram illustrating a controller of the image forming apparatus.

FIG. 3 is a functional block diagram illustrating the controller 41 of the image forming apparatus 1. The controller 41 includes a pattern generator 71, a wavelength determiner 72, and an adhesion amount calculator 73. The pattern generator 71 determines a position in which an adjustment pattern T is to be generated on the intermediate transfer belt 51. The wavelength determiner 72 determines which wavelength should be used for calculation of a toner adhesion amount on the adjustment pattern T the position of which is determined by the pattern generator 71. The adhesion amount calculator 73 calculates a toner adhesion amount based on an output of the wavelength determined by the wavelength determiner 72.

Each of the pattern generator 71, the wavelength determiner 72, and the adhesion amount calculator 73 functions when the CPU of the controller 41 executes a program stored in the memory. Moreover, the controller 41 includes a storage unit 74 as a memory to store, for example, an adhesion amount calculation table and various parameters.

(Adhesion Amount Calculation Process)

The image forming apparatus 1 performs a density adjustment process at a predetermined time to stabilize image density. The term "predetermined time" used herein includes, for example, when a printer power source is turned on, when an image forming operation is started, a time between conveyance of sheets when a continuous image forming process is performed, and when the image forming is finished.

In the density adjustment process executed by the image forming apparatus 1, the pattern generator 71 determines a position in which an adjustment pattern T of each color is to be generated on the intermediate transfer belt 51, and then the image forming unit 43 generates the adjustment pattern T in the position determined by the pattern generator 71. Subsequently, the density sensor 40 reads density of the generated adjustment pattern T, and the adhesion amount calculator 73 calculates a toner adhesion amount of the adjustment pattern T of each color (this operation is called an adhesion amount calculation process). Herein, the wavelength determiner 72 determines which wavelength should be used by the adhesion amount calculator 73 for calculation of the toner adhesion amount.

Then, the image forming apparatus 1 adjusts an image forming condition based on the toner adhesion amount of each color calculated by the adhesion amount calculation process. After the adhesion amount calculation process, the image forming apparatus 1 performs feedback control with respect to an image forming control parameter based on the calculated toner adhesion amount. The feedback control can be performed according to a known method or a new method. That is, the feedback control itself is not particularly limited to any one method.

Hereinafter, the adhesion amount calculation process executed by the image forming apparatus 1 according to the present exemplary embodiment is described.

In the adhesion amount calculation process, for example, a C-toner adhesion amount is calculated using a B output of the density sensor 40, an M-toner adhesion amount is calculated using an R output of the density sensor 40, and a Y-toner adhesion amount is calculated using R+G outputs of the density sensor 40.

On the other hand, a black toner adhesion amount is calculated using an output that is determined based on color information of the intermediate transfer belt 51, instead of using the same output all the time.

Such a black toner adhesion amount calculation process is described.

Figure 4:
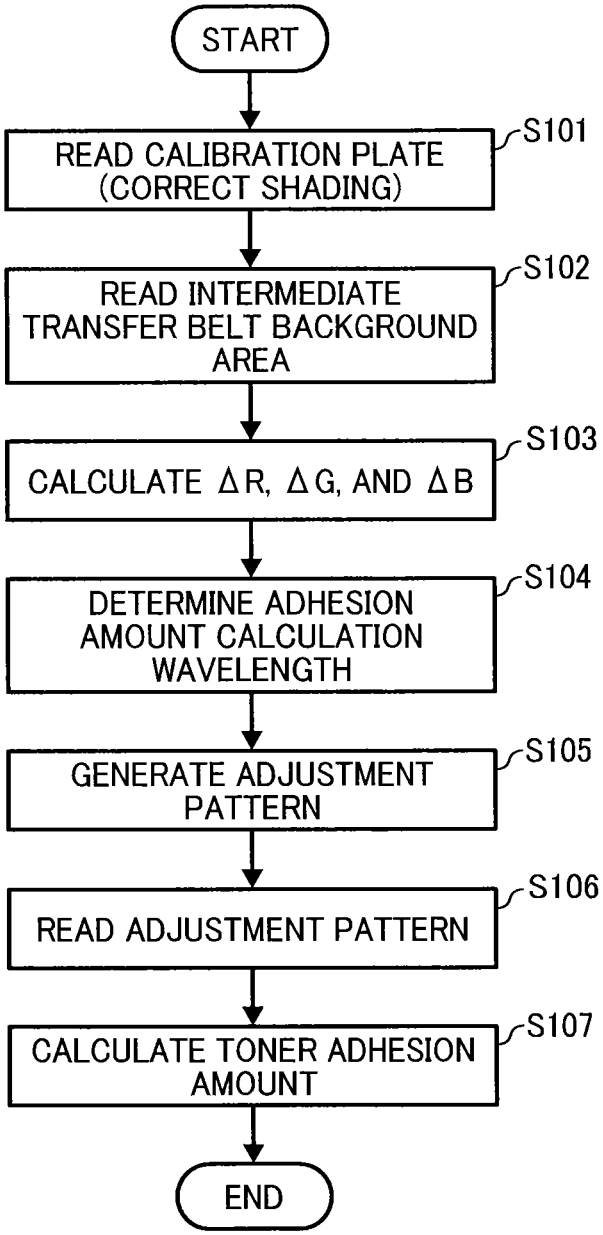
FIG. 4 is a flowchart illustrating steps in one example of an adhesion amount calculation process.

FIG. 4 is a flowchart illustrating steps in one example of a process for calculating a black toner adhesion amount on the intermediate transfer belt 51 by using the density sensor 40.

In step S101, the density sensor 40 reads a calibration plate to correct shading before reading a toner adhesion amount. The shading correction using the calibration plate can be performed by a known method, and is not particularly limited to any one method.

In step S102, the density sensor 40 reads a portion of the intermediate transfer belt 51 in which a toner image is not formed (the portion is called an intermediate transfer belt background area) to acquire color information of the intermediate transfer belt 51.

In step S103, the controller 41 calculates ΔR, 66 G, and ΔB based on the acquired color information. Subsequently, in step S104, the controller 41 determines a wavelength to be used for toner adhesion amount calculation (also referred to as an adhesion amount calculation wavelength).

The operations in steps 103 and 104 will be described in detail with reference to FIG. 5.

In step S105, the image forming unit 43 generates adjustment patterns T of respective colors of C, M, Y, and Bk on the intermediate transfer belt 51. In step S106, the density sensor 40 reads these adjustment patterns T.

Subsequently, in step S107, the controller 41 calculates a black toner adhesion amount by using the output determined in step S104 for black toner adhesion amount calculation out of R, G, and B.

For the black toner adhesion amount calculation in step S107, a table indicating a relation between an adhesion amount and an output for each of the R, G, and B signals (a adhesion amount calculation table) is prepared beforehand. This table is stored in the storage unit 74 beforehand such that any of R, G, and B can be selected in the operation in step S107.

In the adhesion amount calculation process illustrated in FIG. 4, the generation of the adjustment pattern T (step S105) and the reading of the adjustment pattern T (step S106) may be performed before the wavelength is determined (step S104). In such a case, the generation of the adjustment pattern T (step S105) and the reading of the adjustment pattern T (step S106) need to be performed after the intermediate transfer belt background area is read (step S102). Moreover, the reading of the calibration plate may be performed (step S101) after the adjustment pattern T is read (step S106) as long as the reading of the calibration plate can be performed (step S101) before the adhesion amount is calculated (step S107).

An adhesion amount of each of the C, M, and Y toners is calculated using the above-described output. The image forming apparatus 1 adjusts an image forming condition based on the calculated toner adhesion amount of each color.

(Wavelength Determination Process)

Next, the wavelength determination process (steps S103 and step S104 in the flowchart illustrated in FIG. 4) is described in detail with reference to FIG. 5.

In the wavelength determination process, an intermediate transfer belt background area is read, and a wavelength or a combination of wavelengths to be used for calculation of a black toner adhesion amount is selected/determined based on the acquired color information of the intermediate transfer belt 51. FIG. 5 is a flowchart illustrating steps in one example of the wavelength determination process.

In step S201 (step S103 of the flowchart illustrated in FIG. 4), the controller 41 calculates ΔR, 66 G, and ΔB. In this step, outputs of R, G, and B acquired by reading the intermediate transfer belt background area are respectively set to color information VR, VG, and VB of the intermediate transfer belt 51. The acquired color information (VR, VG, and VB) of the intermediate transfer belt 51 is compared with color information (VR', VG', and VB') of the black toner. The color information (VR', VG', and VB') of the black toner is stored beforehand in the storage unit 74. An output difference between the color information of the intermediate transfer belt 51 and the color information of the black toner, that is, ΔR=VR−VR', ΔG=VG−VG', and ΔB=VB−VB', is calculated for each of R, G, and B.

In steps S202 through S208, the controller 41 determines whether each of ΔR, ΔG, and ΔB is a positive or negative value. If any of ΔR, ΔG, and ΔB is a positive value, and a reflectance of the intermediate transfer belt 51 is overall lower than that of the black toner, the operation proceeds to steps S209 through S215 in which an adhesion amount is calculated using only a positive signal from ΔR, ΔG, and ΔB. That is, the adhesion amount is calculated using only a wavelength by which an output increases with an increase in the toner adhesion amount.

On the other hand, if all of ΔR, ΔG, and ΔB are negative values, an output decreases as increase in the black toner adhesion amount. Accordingly, in step S216, the image forming apparatus 1 determines that an error has occurred and executes an error handling process.

Figure 6:
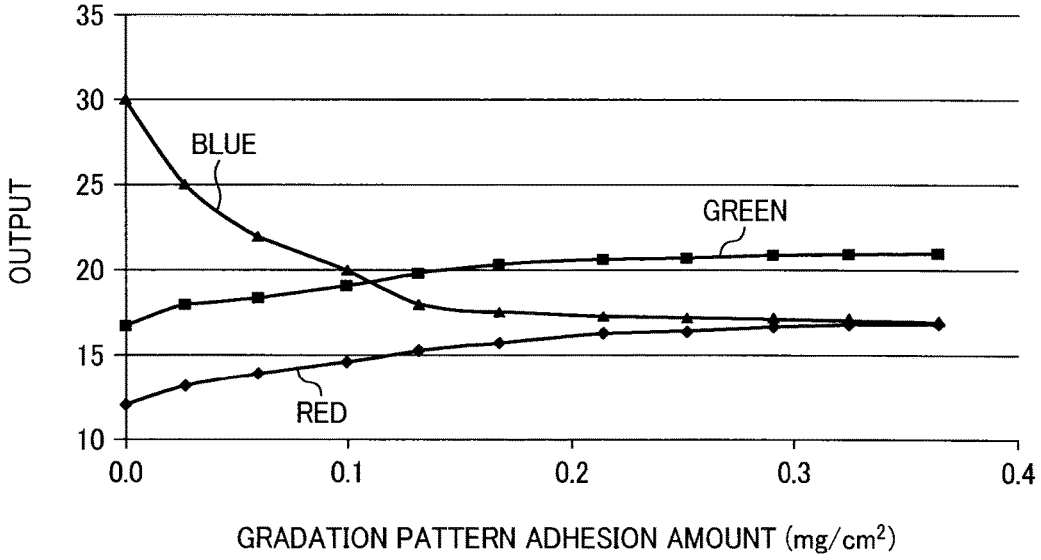
FIG. 6 is a graph illustrating a relation between a black toner adhesion amount on an intermediate transfer belt and each of red, green, and blue (R, G, and B) outputs.

For example, as illustrated in FIG. 6, if color information R, G, and B of the intermediate transfer belt 51 is respectively 12, 17, and 30, and color information of the black toner is 17, 21, and 17, ΔR, 66 G, and ΔB are as follows, ΔR>0, ΔG>0, and ΔB<0.

Figure 5:
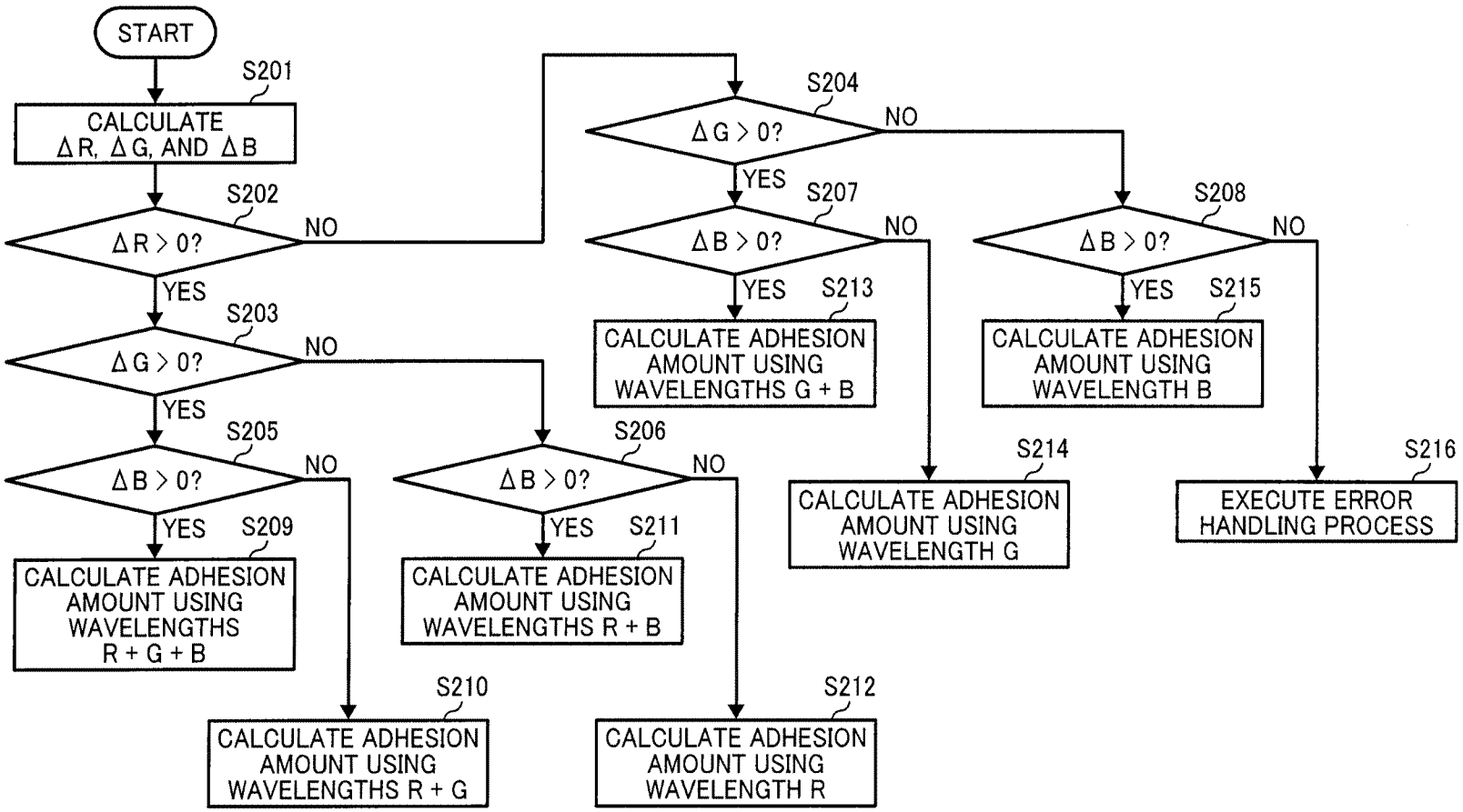
FIG. 5 is a flowchart illustrating steps in one example of a wavelength determination process.

Therefore, in step S210 as illustrated in FIG. 5, the controller 41 calculates an adhesion amount by adding the R signal to the G signal.

Herein, an output difference between the color information of the intermediate transfer belt 51 and the color information of the black toner in terms of only R is 6, and in terms of only G is 4. Such output differences of 6 and 4 are relatively small. However, the use of outputs of R+G can increase an output difference of the color information of the intermediate transfer belt 51 and the color information of the black toner to 9, thereby enhancing adhesion amount calculation accuracy. On the other hand, since an output of B decreases with an increase in an adhesion amount, the use of outputs of R+G+B produces an output difference of −4 which is smaller than that of R+G.

Accordingly, since an output difference between the color information of the black toner and the color information of the intermediate transfer belt 51 is relatively small, only a wavelength having a high toner reflectance with respect to the intermediate transfer belt 51 is used to calculate an adhesion amount. This can obtain an output difference, and a black toner adhesion amount can be calculated with good accuracy.

Moreover, the controller 41 can determine whether each of ΔR, ΔG, and ΔB is a positive or negative value. Then, if AR+AG+AB<0, and reflectances of the intermediate transfer belt 51 are overall higher than that of the black toner, an adhesion amount can be calculated using only a negative signal from ΔR, 66 G, and ΔB. This can obtain an advantage similar to the above although a detailed description is omitted.

[Second Exemplary Embodiment]

Hereinafter, another exemplary embodiment of the image forming apparatus is described. Components and configurations that are similar to the above exemplary embodiment are given the same reference numerals as above and description thereof will be omitted.

(Adhesion Amount Calculation Process)

When an image forming apparatus 1 repeats image formation, toner filming occurs on an intermediate transfer belt 51 over time. The toner filming changes color of the intermediate transfer belt 51. Consequently, as the apparatus ages, a toner adhesion amount cannot be accurately calculated by using light having the same wavelength as that at the beginning of use (new) of the intermediate transfer belt 51.

The present exemplary embodiment is described using an example in which a black toner adhesion amount calculation process is performed when toner filming occurs on the intermediate transfer belt 51 over time.

Figure 7:
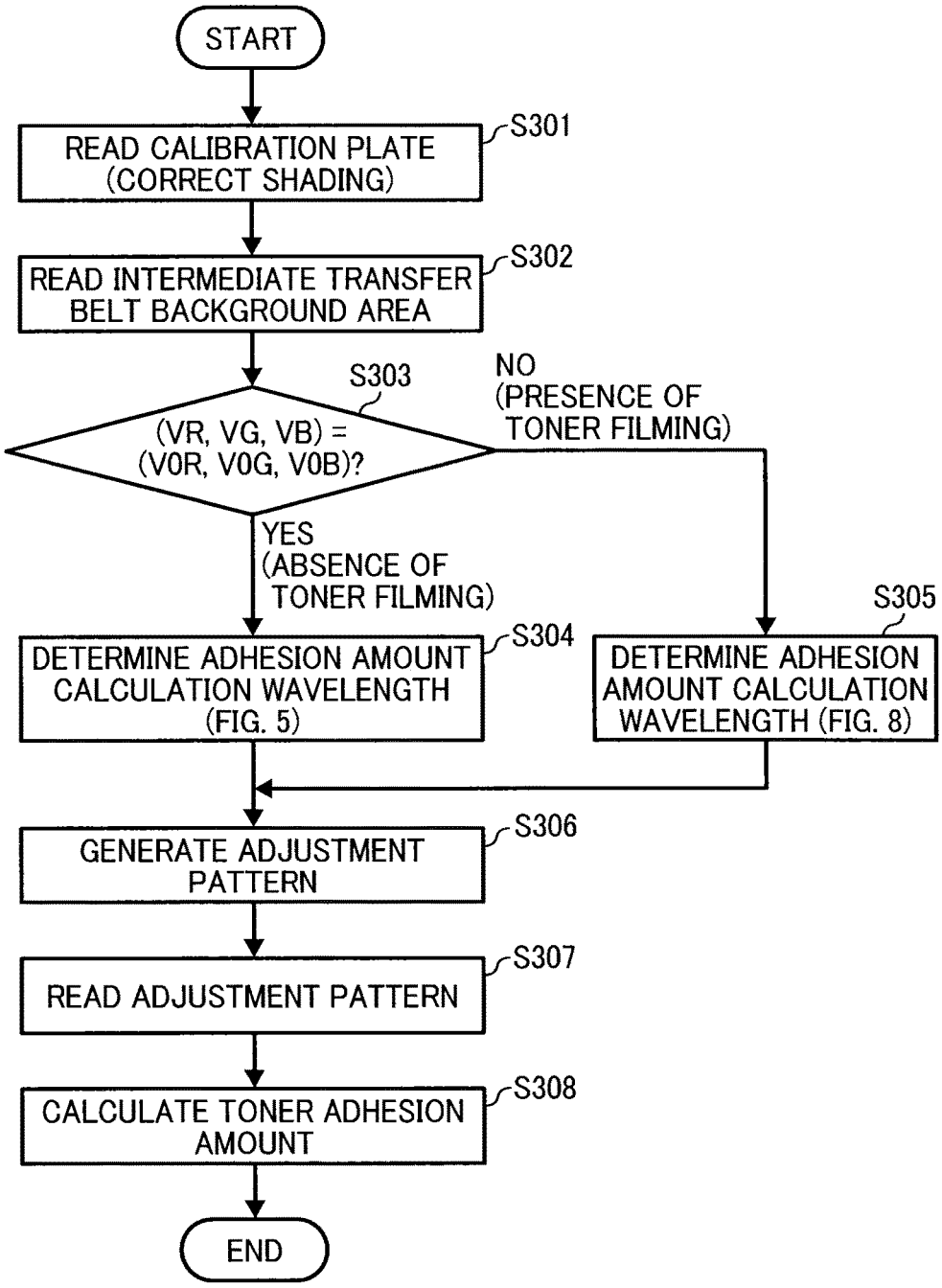
FIG. 7 is a flowchart illustrating steps in another example of an adhesion amount calculation process.

FIG. 7 is a flowchart illustrating steps in one example of a process by which a black toner adhesion amount on the intermediate transfer belt 51 is calculated using a density sensor 40.

When the intermediate transfer belt 51 begins to be used, an output of an intermediate transfer belt background area is read in advance to record color information (V0R, V0G, V0B) at the beginning of use of the intermediate transfer belt 51 in a storage unit 74.

In step S301, the density sensor 40 first reads a calibration plate to correct shading at the time of a density adjustment process. Subsequently, in step S302, the density sensor 40 reads the intermediate transfer belt background area to acquire current color information (VR, VG, VB) of the intermediate transfer belt 51.

In step S303, a controller 41 determines whether the acquired current color information (VR, VG, VG) and the color information (V0R, V0G, V0B) at the beginning of use of the intermediate transfer belt 51 are substantially the same to determine the presence or absence of toner filming on the intermediate transfer belt 51. Alternatively, the determination in step S303 may be made using a predetermined threshold (margin). In such a case, the controller 41 determines whether the current color information and the predetermined threshold are substantially the same.

If the current color information is the same as the color information at the beginning of use of the intermediate transfer belt 51 (YES in step S303), the controller 41 determines that there is no toner filming and the operation proceeds to step S304. In step S304, the controller 41 performs a wavelength determination process that is described in the above exemplary embodiment (steps S201 through S215 of the flowchart illustrated in FIG. 5) to determine a wavelength to be used for calculation of a black toner adhesion amount.

On the other hand, if the current color information differs from the color information at the beginning of use of the intermediate transfer belt 51 (NO in step S303), the controller 41 determines that there is toner filming and the operation proceeds to step S305. In step S305, the controller 41 performs a wavelength determination process described with reference to FIG. 8 to determine a wavelength to be used for calculation of the black toner adhesion amount.

Subsequently, in step S306, the image forming unit 43 generates adjustment patterns T of cyan, magenta, yellow, and black. In step S307, the density sensor 40 reads the generated adjustment patterns T.

In step S308, the controller 41 calculates a black toner adhesion amount using the output determined to be used for calculation of the black toner adhesion amount out of R, G, and B.

(Wavelength Determination Process)

Figure 8:
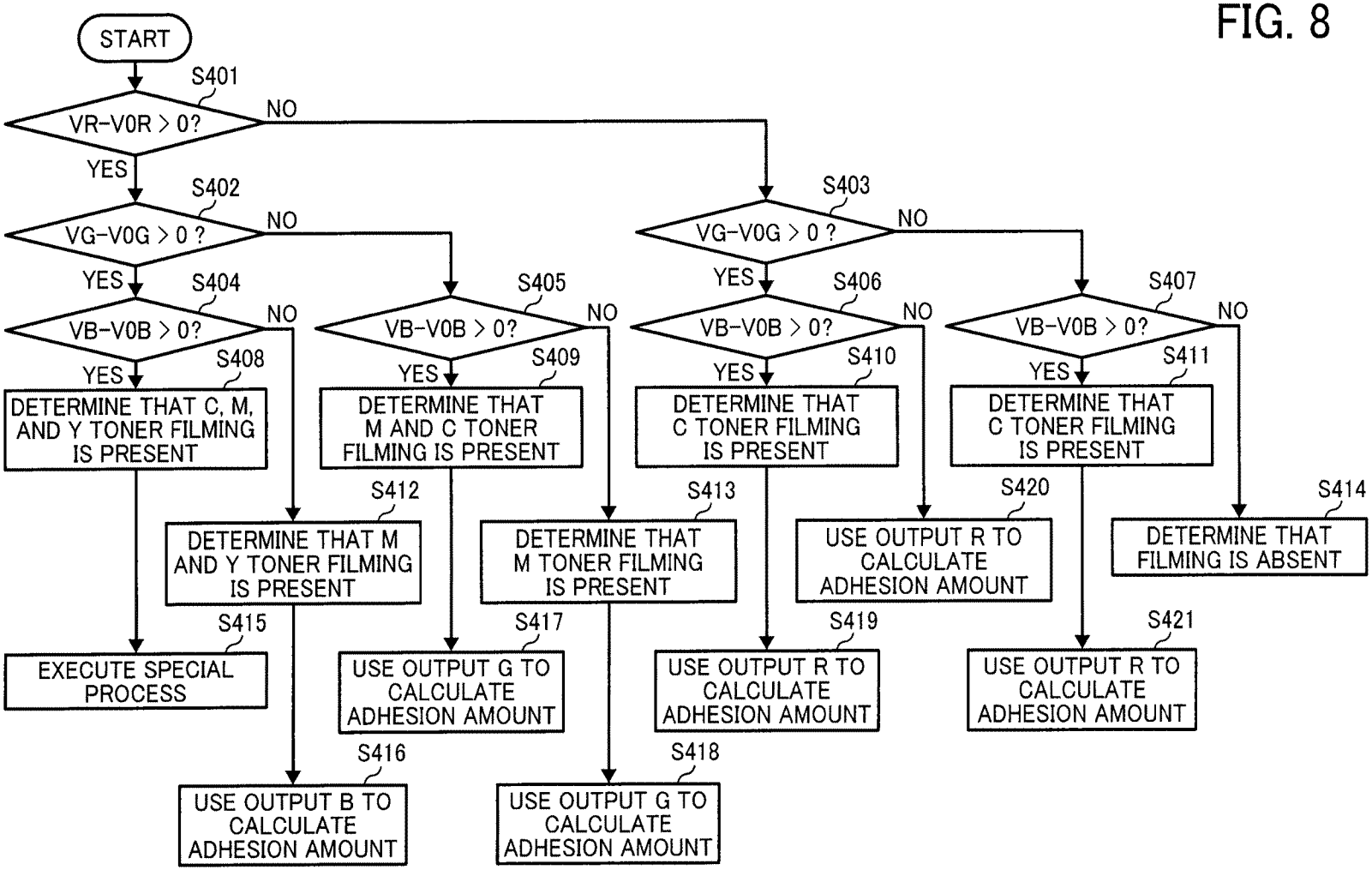
FIG. 8 is a flowchart illustrating steps in one example of a wavelength determination process performed when toner filming is present.

Next, the wavelength determination process (step S305 of the flowchart illustrated in FIG. 7) is described in detail with reference to FIG. 8. FIG. 8 is a flowchart illustrating steps in one example of the wavelength determination process that takes into consideration of toner filming.

When toner filming is present, the wavelength determination process is performed to determine a combination of wavelengths to be used for calculation of a black toner adhesion amount.

In steps S401 through S407, the controller 41 determines a difference between current color information (VR, VG, VB) of the intermediate transfer belt 51 and color information (V0R, V0G, V0B) at the beginning of use of the intermediate transfer belt 51. In steps S408 through S414, the controller 41 determines whether toner filming is present based on the difference, and then determines a toner with which the filming has occurred if the toner filming is present. Accordingly, in steps S416 through S421, the controller 41 determines which output is used out of R, G, and B to calculate an adhesion amount of the black toner.

For example, if the controller 41 determines that only an output of R is increased relative to that at the beginning of use of the intermediate transfer belt 51 as a result of reading the current color information (NO in step S405), the operation proceeds to step S413.

In step S413, the controller 41 can determine that toner filming of the magenta toner has occurred.

Meanwhile, a black toner adhesion amount is calculated using a wavelength of G having a lower reflectance of the magenta toner with which the toner filming has occurred. As illustrated in FIG. 9B, since an output of G does not change even when the magenta toner filming occurs, a black toner adhesion amount can be calculated without being affected by toner filming. Accordingly, calculation of an adhesion amount using a wavelength that is not affected by toner filming enables the toner adhesion amount to be accurately detected.

On the other hand, if the controller 41 determines that all signals of R, G, and B have increased relative to those at the beginning of use of the intermediate transfer belt 51 as a result of reading the current color information (YES in step S404), the operation proceeds to step S408. In the step S408, the controller 41 determines that toner filming of three colors of C, M, and Y has occurred. That is, a surface state of the intermediate transfer belt 51 is not good. Subsequently, in step S415, the controller 41 executes a special process.

In the special process performed in step S415, for example, an adjustment pattern T is not generated in a toner filming occurrence area. Since an output difference with respect to toner is greater on a belt surface having no toner filming, the adjustment pattern T is generated in an area other than the toner filming occurrence area. This enables a toner adhesion amount to be calculated with accuracy.

In the process for generating the adjustment pattern T in an area other than the toner filming occurrence area, for example, an output of an intermediate transfer belt background area is measured for one rotation of the intermediate transfer belt 51 to acquire color information for one rotation of the intermediate transfer belt background area before the adjustment pattern T is generated.

Accordingly, the adjustment pattern T is generated in an area other than an area in which toner filming has occurred with the predetermined number of colors or more (e.g., three colors of C, M, and Y). Thus, the adjustment pattern T can be generated on a belt surface the state of which is similar to that of the intermediate transfer belt 51 at the beginning of use. This enables a toner adhesion amount to be detected with good accuracy.

Moreover, in the special process performed in step S415, for example, a toner filming occurrence area cannot be used in the calculation of an adhesion amount. For example, a color difference between the intermediate transfer belt 51 and the black toner is smaller in an area where toner filming has occurred with the predetermined number of colors or more (e.g., three colors of C, M, and Y). This degrades adhesion amount detection accuracy in the toner filming occurrence area. The calculation of toner amount excluding the toner filming occurrence area enables a black toner adhesion amount to be accurately detected.

Such a process is described. Even if toner filming occurs, calculation of color toner amount is less affected. Accordingly, before an adjustment pattern T is generated, outputs of an intermediate transfer belt background area are measured for one rotation of the intermediate transfer belt 51 to acquire color information for one rotation of the intermediate transfer belt background area. With such color information, a toner filming area of three colors of C, M, and Y is identified.

Then, the adjustment pattern T is generated such that an adhesion amount is calculated for an area other than the toner filming area of three colors only when a black toner adhesion amount is calculated. On the other hand, color toners can have adequate sensitivity even if three-color filming has occurred. Hence, an adhesion amount is calculated for the entire area without consideration of the filming area. Since the three-color filming area is not used in the black toner adhesion amount calculation, a black toner adhesion amount can be calculated with good accuracy without an influence from the toner filming.

Therefore, such an image forming apparatus 1 can calculate a toner adhesion amount of an image bearer with good accuracy.

That is, when a toner adhesion amount of a toner image formed on the intermediate transfer belt 51 as an image bearer is calculated, a wavelength to be used for the toner adhesion amount calculation is determined based on color information of the intermediate transfer belt 51. Then, the detection result is fed back to an image forming control parameter, so that image density can be maintained constant.

Moreover, since color of the intermediate transfer belt 51 is read by the sensor 40, which also reads a toner adhesion amount, a separate sensor for reading color information is not necessary. This can prevent an increase in costs.

Moreover, a wavelength having a large reflectance difference between the intermediate transfer belt 51 and toner is used to calculate a toner adhesion amount, so that the toner adhesion amount can be detected with good accuracy.

In addition, even if toner filming occurs on the intermediate transfer belt 51, a wavelength for adhesion amount calculation can be selected in consideration of the toner filming. This enables a toner adhesion amount to be detected with good accuracy not only at the beginning of use of the intermediate transfer belt 51 but also over time.

Herein, color information of the intermediate transfer belt 51 at the adjustment operation (after a change occurs over time) and color information of the intermediate transfer belt 51 at the beginning of use can be compared to determine which color of toner has generated a film on a surface of the intermediate transfer belt 51. A wavelength to be used for adhesion amount calculation is selected based on the determination result, so that an amount of the toner that has adhered over time can be calculated with good accuracy.

Moreover, application of such a method in black toner adhesion amount calculation enables a reading wavelength to be appropriately selected even though black toner has a low sensitivity with respect to an adhesion amount due to similar color to the intermediate transfer belt 51. Hence, the toner adhesion amount can be calculated with good accuracy. Application of the above method is not necessarily limited to the black toner.

The exemplary embodiment has been described using an example in which the intermediate transfer belt 51 as an image bearer is used. However, the exemplary embodiment of the present invention is not limited thereto. The exemplary embodiment of the present invention may be applied to other image bearers such as a non-belt intermediate transfer member, a photoconductor, and a secondary transfer member (a belt or a roller). In such a case, toner on the other image bearer can be read.

The exemplary embodiment has also been described using an example in which the density sensor 40 serves as a line sensor. The use of the density sensor 40 enables an adjustment pattern T to be generated in a suitable position based on color information of the intermediate transfer belt 51 in the entire main scanning area and to be read by a suitable wavelength. Hence, a toner adhesion amount can be calculated with good accuracy. The density sensor 40 is not limited to a line sensor. Alternatively, an actuator may move the density sensor 40 in a main scanning direction on the intermediate transfer belt 51 to acquire color information of the intermediate transfer belt 51 of the entire main scanning direction.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

an image bearer to bear a toner image;

a sensor including:

a light source to emit light onto the image bearer; and an image element, sensitive to a plurality of wavelength regions each having a different visible light range, to detect reflected light that is emitted from the light source and reflected from a background area of the image bearer on which the toner image is not formed to determine color information of the background area; and circuitry to calculate a toner adhesion amount of the toner image on the image bearer based on the reflected light, which has at least one wavelength among a plurality of wavelengths detected by the sensor, and determine, based on only the color information of the background area of the image bearer detected by the sensor, a wavelength to be used in calculation of the toner adhesion amount.

2. The image forming apparatus according to claim 1, wherein the circuitry calculates the toner adhesion amount upon determination of the wavelength to be used, the toner adhesion amount including a black toner adhesion amount of a black toner image on the image bearer.

3. The image forming apparatus according to claim 1, wherein the circuitry compares the color information of the background area of the image bearer with color information of one or more predetermined toners to select a wavelength that maximizes a difference between the color information of the background area of the image bearer and the color information of the one or more predetermined toners.

4. The image forming apparatus of claim 1, wherein the color information of the background area of the image bearer includes a plurality of reflectance values in correspondence with the plurality of wavelengths, and the circuitry determines difference values between the plurality of reflectance values and a reflectance of a predetermined color of toner, and determines the wavelength based on the determined difference values.

5. An image forming apparatus, comprising:

an image bearer to bear a toner image;

a sensor including:

a light source to emit light onto the image bearer, and an image element, sensitive to a plurality of wavelength regions each having a different visible light range, to detect reflected light that is emitted from the light source and reflected from a background area of the image bearer; and circuitry to calculate a toner adhesion amount of the toner image on the image bearer based on the reflected light having at least one wavelength among a plurality of wavelengths detected by the sensor, and determine, based on color information of the image bearer detected by the sensor, a wavelength to be used in calculation of the toner adhesion amount, wherein the color information of the image bearer includes toner filming information of the image bearer.

6. The image forming apparatus according to claim 5, wherein the toner filming information is acquired based on the color information of the image bearer detected by the sensor and color information of the image bearer initially detected by the sensor at initial use of the image bearer.

7. The image forming apparatus according to claim 5, wherein the wavelength determiner selects a wavelength that lowers a reflectance with respect to toner with which toner filming has occurred as the wavelength to be used in calculation of the toner adhesion amount by the adhesion amount calculator.

8. The image forming apparatus according to claim 5, further comprising a pattern generator to generate, based on the toner filming information, the toner image in a location on the image bearer where toner filming is not occurring.

9. The image forming apparatus according to claim 5, wherein, if toner filming is occurring with a predetermined number of toners or more, the adhesion amount calculator does not calculate a toner adhesion amount in a location on the image bearer where the toner filming is occurring.

10. A method for controlling an image forming condition of an image forming apparatus including an image bearer and a sensor, the method comprising:

forming a toner image on the image bearer of the image forming apparatus;

detecting, by the sensor, reflected light having a plurality of wavelengths reflected from a background area of the image bearer on which the toner image is not formed to determine color information of the background area;

calculating a toner adhesion amount of the toner image on the image bearer based on the reflected light which has at least one wavelength among the plurality of wavelengths detected by the sensor; and determining, based on only the color information of the background area of the image bearer detected by the sensor, a wavelength to be used in calculation of the toner adhesion amount.

* * * * *